US005993109A

United States Patent [19]

Motl et al.

[11] Patent Number: 5,993,109

[45] Date of Patent: Nov. 30, 1999

[54] POWER TROWEL WITH COUNTERBALANCED TROWEL BLADE PITCH ADJUST ASSEMBLY

[75] Inventors: Robert M. Motl; Ronald R. Sartler, both of West Bend; Todd Lutz, Waukesha; Darin Noyes, Salem, all of Wis.

[73] Assignee: Wacker Corporation, Menomonee, Wis.

[21] Appl. No.: 08/898,676

[22] Filed: Jul. 22, 1997

[51] Int. Cl.[6] ..... E01C 19/22

[52] U.S. Cl. ..... 404/112

[58] Field of Search ..... 56/11.3; 404/112

[56] References Cited

U.S. PATENT DOCUMENTS

| | | | |
|---|---|---|---|
| 752,884 | 2/1904 | Carmichael . | |
| 1,089,948 | 3/1914 | Nohr . | |
| 1,150,871 | 8/1915 | Mainwaring . | |
| 1,422,350 | 7/1922 | Emerson . | |
| 2,230,850 | 2/1941 | Sommerfeld . | |
| 2,342,702 | 2/1944 | Sherman . | |
| 2,375,026 | 5/1945 | Mott . | |
| 2,468,981 | 3/1949 | Huffman . | |
| 2,581,512 | 1/1952 | Baldwin . | |
| 2,621,568 | 12/1952 | Fletcher . | |
| 2,789,875 | 4/1957 | Van Ordt . | |
| 2,887,934 | 5/1959 | Whiteman . | |
| 2,979,996 | 4/1961 | Spitler et al. . | |
| 2,989,334 | 6/1961 | Browne . | |
| 3,412,657 | 11/1968 | Colizza et al. . | |
| 4,320,986 | 3/1982 | Morrison . | |
| 4,577,993 | 3/1986 | Allen et al. | 404/112 |
| 4,673,311 | 6/1987 | Whiteman, Jr. | 404/112 |
| 5,205,669 | 4/1993 | Neff | 404/112 |
| 5,372,452 | 12/1994 | Hodgson | 404/112 |

FOREIGN PATENT DOCUMENTS

| | | |
|---|---|---|
| 867728 | 5/1961 | United Kingdom . |

*Primary Examiner*—Thomas B. Will
*Assistant Examiner*—Raymond W. Addie
*Attorney, Agent, or Firm*—Nilles & Nilles, S.C.

[57] ABSTRACT

A power trowel incorporates a counterbalanced blade pitch adjust assembly that is relatively easy to manufacture and to install (and hence that can be retrofitted onto an existing power trowel machine) and that is easy to operate. The blade pitch adjust assembly includes 1) a blade pitch adjustment mechanism, 2) a pivotable control lever assembly that is coupled to the adjustment mechanism by a cable or other tension element, and 3) a counterbalancing mechanism such as a torsion spring. The counterbalancing mechanism imposes a force on the control lever assembly that is significantly lower than the resistive force imposed on the control lever assembly by the tension element to avoid potentially dangerous control lever snap-back and to provide the operator with a sense of feel as he or she adjusts blade pitch. A latch mechanism is incorporated into the system that releases automatically when the operator applies a pivotal force to the control lever assembly—thereby obviating the need to effect a secondary release operation. The orientation of the control lever assembly also can be adjusted to meet the needs of the operator.

24 Claims, 6 Drawing Sheets

POWER TROWEL WITH COUNTERBALANCED TROWEL BLADE PITCH ADJUST ASSEMBLY

BACKGROUND OF THE INVENTION

1. Field of the Invention

The invention relates to a power trowel having an improved trowel blade pitch adjust assembly. The invention additionally relates to a method of operating a power trowel having a counterbalanced trowel blade pitch adjust assembly.

2. Discussion of the Related Art

Power trowels, often known as concrete finishing machines, are widely used for leveling and famishing concrete or the like. A typical power trowel machine includes a frame on which are mounted trowel arms projecting radially outwardly from a common hub which in turn is driven to rotate by an engine. Generally planar trowel blades are mounted on the trowel arms. The trowel blades rest directly on the surface to be finished and support the entire machine's weight. The machine is guided by a tubular machine handle extending upwardly and rearwardly from the frame.

The inclination or pitch of the trowel blades of many power trowels can be adjusted "on the fly" to optimize finishing. Specifically, the pitch is adjusted between each pass as the machine makes several passes over the concrete surface as the concrete hardens. In the initial pass, when the concrete is still very wet and plastic, the blade pitch is usually adjusted to be substantially parallel with the concrete surface so that the blades lie flat upon the surface and spread the machine's weight over a maximum surface area. In subsequent passes, as the concrete hardens and becomes less plastic, the blade pitch is progressively increased so that the machine's weight is spread over a smaller surface area with a resultant increase in pressure.

The typical power trowel blade pitch adjust assembly comprises a thrust collar that cooperates with a yoke pivotally secured to the machine's frame to pivot the trowel blades. A tension cable interconnects the yoke with a pitch adjust actuator—typically a screw handle that is located at the remote end of the tubular machine handle. Rotation of the screw handle adjusts the yoke's angle to move the thrust collar up or down a corresponding amount thereby to provide the desired trowel blade pitch adjustment. A power trowel having this type of blade pitch adjust assembly is disclosed, e.g., in U.S. Pat. No. 2,887,934 to Whiteman.

The typical power trowel weighs several hundred pounds. Since the entire weight of the machine rests on the trowel blades, blade pitch adjustment must be performed against a considerable resistive force imposed by the trowel blades through the cable. The threads of the traditional screw handle must have an extremely fine pitch to permit blade pitch adjustment using a reasonably low level of operator effort. Consequently, the blade pitch may be adjusted only very slowly.

It has been recognized that blade pitch adjustment can be effected more rapidly and with less effort if a counterbalancing mechanism were to be incorporated into the blade pitch adjust assembly that offsets the force imposed on the pitch adjust actuator by the weight of the machine resting on the trowel blades. For example, U.S. Pat. No. 4,673,311 to Whiteman, Jr. (the Whiteman, Jr. patent) proposes a lever-operated trowel blade pitch adjust assembly having a counterbalancing mechanism that is located within the tubular machine handle and that applies a counterbalancing force to the control lever thereby to permit blade pitch adjustment with substantially less force than otherwise would be required.

The Whiteman, Jr. patent discloses two primary embodiments, both of which employ a coil spring to facilitate operation of the control lever. In Dne embodiment, the spring surrounds the tension cable and is located within the same tubular machine handle that supports the control lever. The spring and cable of this embodiment both act on a common slide block that, in turn, is attached by a connecting rod to a portion of the control lever positioned adjacent the control lever's pivot point. In the second embodiment, the counterbalancing spring is (1) located within a separate tube carried on the underside of the tubular machine handle, and (2) bears at its upper end against a movable block that can slide within the tube. A second tension cable, disposed generally in parallel with the blade pitch adjust cable, interconnects the movable block with the control lever. In a variation of this embodiment, the spring acts on an upper slide block that is connected to a more conventional rotatable screw handle. According to the text of the Whiteman, Jr. patent, the counterbalancing force of this embodiment permits the screw handle to have a very large pitch so that the entire range of cable movement can be traversed conveniently with just a few turns of the screw handle.

In all embodiments, the force imparted by the coil spring is sized to be comparable to the force applied by the cable, thus substantially reducing the effort required to actuate the control lever. As a result, the control lever can be moved to any pivotal position without requiring the operator to apply any significant force.

The blade pitch adjust assemblies disclosed in the Whiteman, Jr. patent exhibit several drawbacks and disadvantages.

For instance, the "comparable force" imposed by the relatively large coil springs is higher than optimal in at least two respects. First, most operators expect some resistance to a mechanically-operated device such as a control lever and might suspect that the blade pitch adjust assembly is not operating properly if they do not encounter some resistance to control lever movement. Operators may also experience difficulty "fine tuning" blade pitch adjustment unless they encounter sufficient resistance to control lever movement to prevent unintended control lever overtravel. Second, the resistance to control lever movement avoids the detrimental effects that otherwise could occur if the biasing force imposed by the spring is too large. For instance, if the control lever is released under conditions in which the tension imposed by the blade pitch cable are reduced or even absent (such as when the power trowel is not resting on the ground), the counterbalancing spring tends to snap the control lever back towards the operator. This snap-back may occur with such force that the operator's fingers are pinched between the control lever and the machine's guide handle.

Moreover, disadvantages arise due to the locations of the coil springs within the tubular machine handle of the Whiteman, Jr. patent. The springs necessarily are connected to the control lever indirectly via a linkage mechanism. The coil springs therefore are inefficient and must be oversized to provide the desired counterbalancing effect. Moreover, because the coil springs are relatively long and cumbersome and hence must be placed inside the tubular machine handle, the blade pitch adjust assembly is relatively difficult to retrofit onto an existing power trowel.

In addition, all of the embodiments of the Whiteman, Jr. patent that employ a pivotal control lever as a blade pitch adjust actuator employ a secondary release system or latch that must be released before the lever can be adjusted. This secondary release mechanism includes a stationary latching gear and a lock that must be released from the gear before the lever can be adjusted. The lock takes a form of a spring-biased locking dog that is connected to a transverse finger. The finger must be manually lifted to raise the locking dog away from the locking gear before the control lever can be pivoted. Blade pitch adjustment is relatively difficult to effect because the operator must simultaneously impart a linear force to retract the locking dog and a pivoting or rotative force to pivot the lever.

In addition, the lever is difficult to access by many operators because it extends within a vertical plane bisecting the tubular machine handle. It would be more accessible if it were rotated some either to the right or to the left of this plane to facilitate access by the operator's dominant hand.

OBJECTS AND SUMMARY OF THE INVENTION

A principal object of the invention is to provide a power trowel incorporating a counterbalanced blade pitch adjust assembly which is relatively simple, compact and efficient.

Another object of the invention is to provide a power trowel having a counterbalanced blade pitch adjust assembly that is relatively easy to retrofit onto an existing power trowel.

In accordance with a first aspect of the invention, these objects are achieved by providing a power trowel including a frame, a plurality of trowel blades each of which has a bottom surface which is configured to rest on a surface to be troweled, a machine handle, and a trowel blade pitch adjust assembly. Each of the trowel blades is rotatable with respect to the frame and has a variable pitch with respect to the frame so that the percentage of the bottom surface of each trowel blade that contacts the surface to be troweled is variable. The machine handle extends upwardly from the frame. The trowel blade pitch adjust assembly selectively adjusts the pitch of the trowel blades. The trowel blade pitch adjust assembly includes 1) an adjuster mechanism which is operatively coupled to the trowel blades and which is selectively actuatable to adjust the pitch of the trowel blades relative to the frame, 2) a pivotable control lever assembly supported on the machine handle, 3) a tension element which is operatively coupled to the adjuster mechanism and to the control lever assembly and which actuates the adjuster mechanism to alter the pitch of the trowel blades upon pivotal motion of the control lever, and 4) a counterbalancing mechanism which imposes a force on the control lever assembly which opposes and at least partially offsets the force imposed on the control lever assembly by the tension element. Both the tension element and the counterbalancing mechanism are connected directly to the control lever assembly.

Preferably, the counterbalancing mechanism comprises a torsion spring having a first end which engages the control lever assembly and a second end which engages a stationary member. The tension element comprises a cable having a first end attached to the adjuster mechanism and a second end directly attached to the control lever assembly.

Still another object of this invention is to provide a power trowel having a counterbalanced blade pitch adjust assembly that does not impose an unacceptably high counterbalancing force on the control lever assembly.

In accordance with a second aspect of the invention, this object is achieved by providing a power trowel which exhibits at least some of the characteristics discussed above in conjunction with the first aspect and in which the force imposed on the control lever assembly by the counterbalancing mechanism is no more than 60%, and preferably between 25% and 50%, of the maximum force imposed on the control lever assembly by the tension element.

Still another object of the invention is to provide a power trowel incorporating a blade pitch adjust assembly including a latch mechanism that releases automatically upon blade pitch adjustment so that a secondary release operation need not be effected.

In accordance with a third aspect of the invention, this object is achieved by providing a power trowel which exhibits at least some of the characteristics discussed above in conjunction with the first and second aspects and the latch mechanism of which releases automatically upon the imposition of pivotal forces on the control lever assembly that exceed a designated magnitude. The latch mechanism preferably comprises 1) a first serrated plate which is rotatably mounted on a support rod, 2) a second serrated plate which is movable axially with respect to the support rod to selectively a) intermesh with the first serrated plate to prevent rotation of the first serrated plate relative to the second serrated plate and b) move away from the first serrated plate to permit the first serrated plate to rotate relative to the second serrated plate and, and 3) a biasing mechanism which biases the second serrated plate into meshing engagement with the first serrated plate.

Yet another object of the invention is to provide a power trowel having a blade pitch adjust assembly having a manually operated actuator such as a control lever assembly the orientation of which relative to a vertical plane bisecting the machine's handle can be adjusted to suit the operator's needs.

In accordance with a fourth aspect of the invention, this object is achieved by providing a power trowel which exhibits at least some of the characteristics discussed above in conjunction with the first through third aspects and the housing of which is adjustably mounted on the machine handle so that its orientation with respect to a vertical plane bisecting the machine handle can be selectively adjusted. Preferably, the machine handle is tubular and the housing includes an annular collar which mates with the machine handle, and the collar rotates about the machine handle during positional adjustment of the housing.

Yet another object of the invention is to provide an improved method of adjusting the blade pitch of a power trowel.

In accordance with still another aspect of the invention, this object is achieved by providing a power trowel having at least some of the characteristics discussed above. Other steps include applying a latching force to the control lever assembly which resists pivotal motion of the control lever assembly, the latching force being applied by a latch mechanism, then releasing the latch mechanism by applying a pivoting force to the control lever assembly of sufficient magnitude to overcome the latching force, and then pivoting the control lever assembly to adjust the pitch of the trowel blades.

Preferably, the latch mechanism automatically reengages upon release of the pivoting force.

These and other objects, features, and advantages of the invention will become apparent to those skilled in the art from the following detailed description and accompanying drawings. It should be understood, however, that the detailed description and specific examples, while indicating preferred embodiments of the present invention, are given by way of illustration and not of limitation. Many changes and modifications may be made within the scope of the present invention without departing from the spirit thereof, and the invention includes all such modifications.

BRIEF DESCRIPTION OF THE DRAWINGS

A preferred exemplary embodiment of the invention is illustrated in the accompanying drawings in which like reference numerals represent like parts throughout, and in which.

DETAILED DESCRIPTION OF THE PREFERRED EMBODIMENTS

1. Resume

Pursuant to the invention, a power trowel is provided which incorporates a counterbalanced blade pitch adjust assembly that is relatively easy to manufacture and to install (and hence that can be retrofitted onto an existing power trowel machine) and that is easy to operate. The blade pitch adjust assembly includes 1) a blade pitch adjustment mechanism, 2) a pivotable control lever assembly that is coupled to the adjustment mechanism by a cable or other tension element, and 3) a counterbalancing mechanism such as a torsion spring. The counterbalancing mechanism imposes a force on the control lever assembly that is significantly lower than the resistive force imposed on the control lever assembly by the tension element to avoid potentially dangerous control lever snap-back and to provide the operator with a sense of feel as he or she adjusts blade pitch. A latch mechanism is incorporated into the system that releases automatically when the operator applies a pivotal force to the control lever assembly—thereby obviating the need to effect a secondary release operation. The orientation of the control lever assembly also can be adjusted to meet the needs of the operator.

2. System Overview

Figure 1:
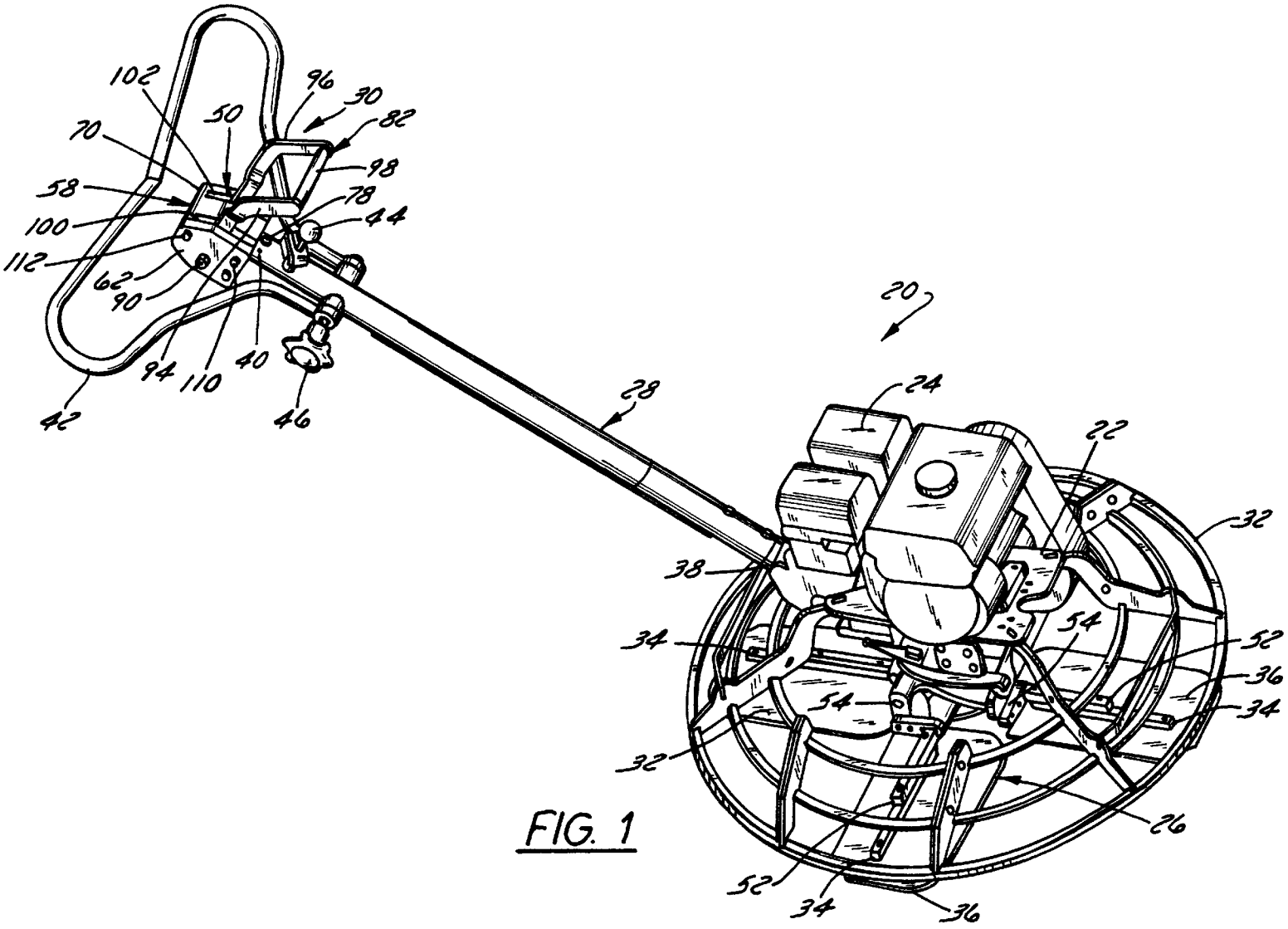
FIG. 1 is a perspective view of a power trowel constructed in accordance with a preferred embodiment of the invention.
Figure 2:
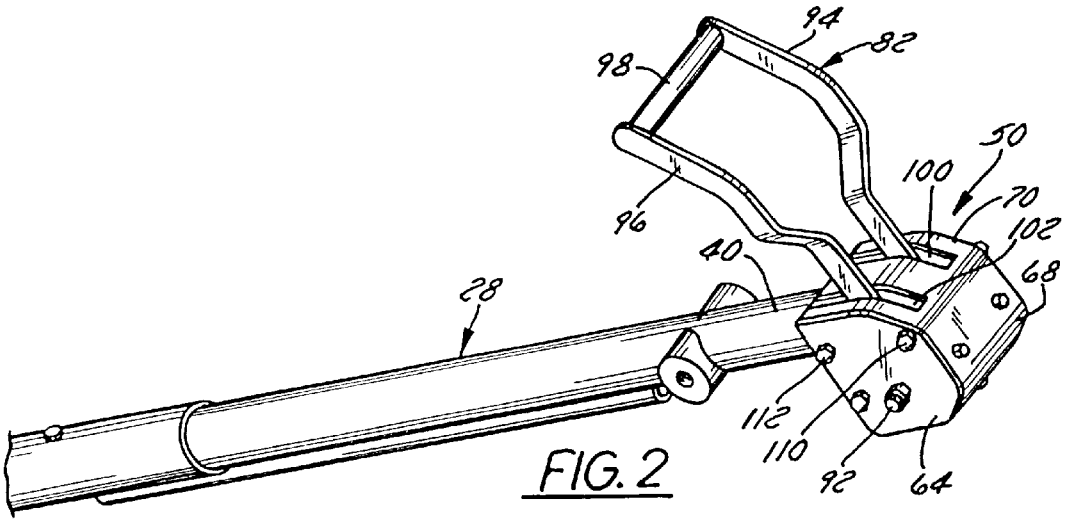
FIG. 2 is a perspective view of an upper portion of the machine handle of the power trowel of FIG. 1 and of a portion of the blade pitch adjust assembly including the control lever assembly.
Figure 3:
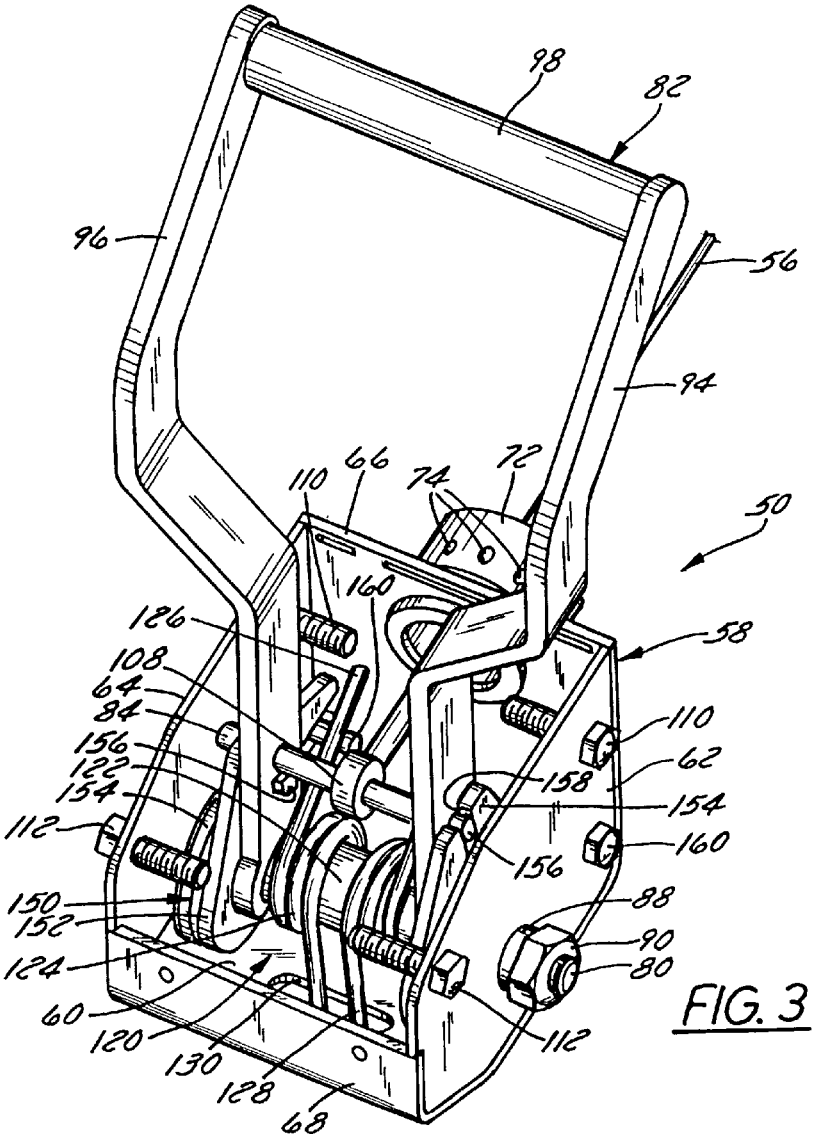
FIG. 3 is a perspective view of the control lever assembly of FIG. 2 and of the cooperating components of the remainder of the power trowel.
Figure 4:
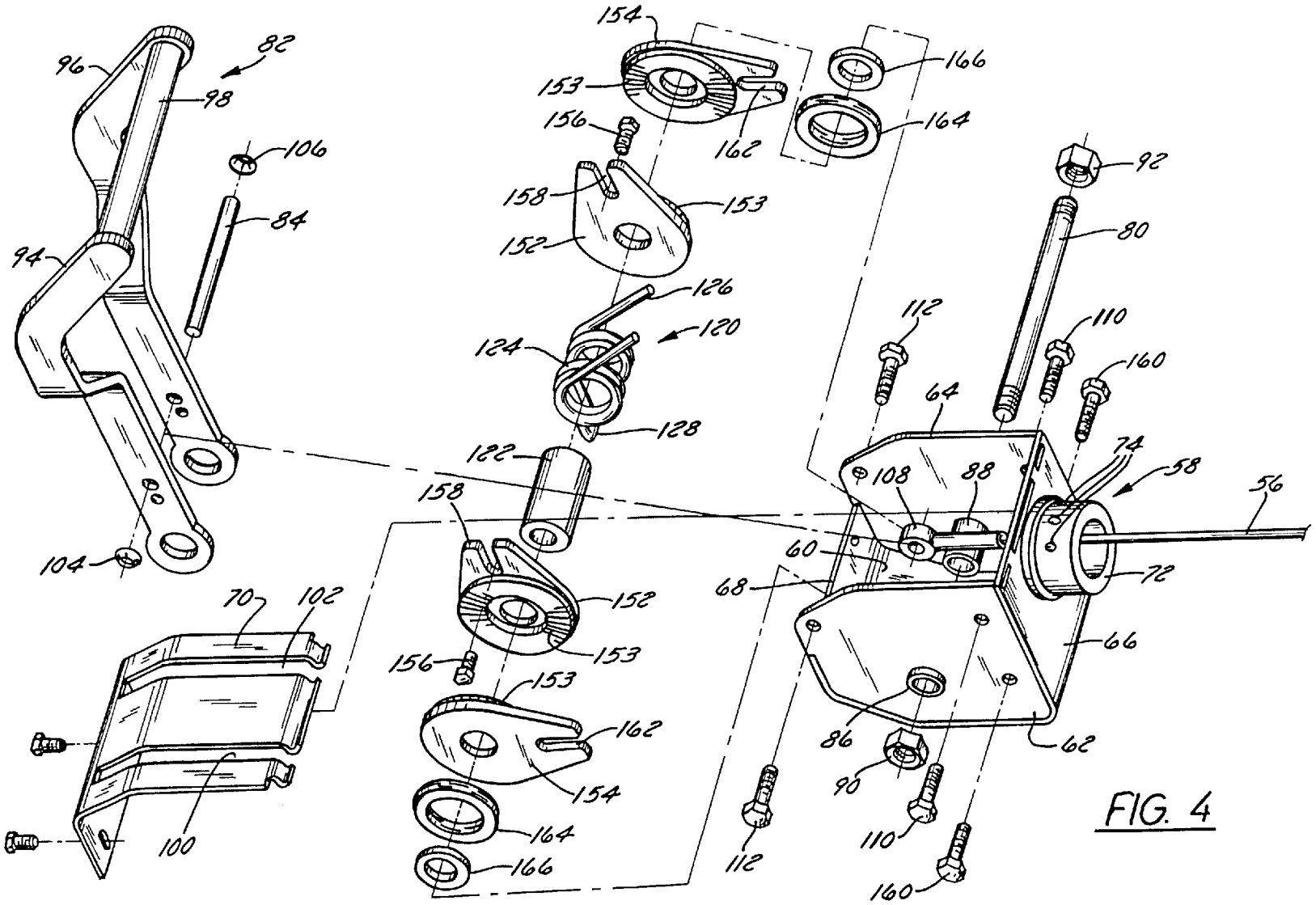
FIG. 4 is an exploded perspective view of the assembly illustrated in FIG. 3.

Referring now to the drawings and initially to FIG. 1 in particular, a power trowel or concrete finishing machine 20 is illustrated that is constructed in accordance with a preferred embodiment of the invention. The power trowel includes a frame 22 that supports an engine 24, a trowel blade assembly 26, a machine handle 28, and a trowel blade pitch adjust assembly 30. A guard ring 32 encircles the peripheral tips of the trowel blades 36 for safety purposes.

The trowel blade assembly 26 includes a plurality (four in the illustrated embodiment) of uniformly-spaced trowel blade arms 34 projecting radially outwardly from a common hub (not shown) that in turn is driven by the engine 24. Each trowel blade arm 34 carries a separate trowel blade 36. The trowel blades 36 are configured to rest directly on a wet, semi-plastic surface formed from concrete or the like.

The machine handle 28 is a conventional tubular structure of the type commonly found in power trowels. The machine handle 28 is fixed to the frame 22 at its lower end 38 and extends upwardly and rearwardly from the frame to an upper end 40. Attached to the upper end 40 are a conventional guide handle assembly 42, a conventional centrifugal engine kill switch 44, a throttle (not shown), and a control lever assembly 50 of the blade pitch adjust assembly 30. The orientation of the guide handle assembly 42 can be adjusted in a conventional manner by operation of an adjuster knob 46.

3. Construction and Operation of Trowel Blade Pitch Adjust Assembly

The purpose of the trowel blade adjust assembly 30 is to effect selective manual adjustment of the pitch of the trowel blades 36 relative to the concrete surface in which they rest. This pitch adjustment is effected according to the concrete's hardness or plasticity, beginning with the blades 36 lying substantially flat on the surface when the concrete is very wet or plastic and ending with the blades 36 at a substantial angle (e.g., 20°) when the concrete has substantially hardened.

The illustrated trowel blade pitch assembly 30 includes an adjuster mechanism cooperating with the trowel blades 36, a control lever assembly 50 mounted on the upper end 40 of the machine handle 28, a tension element 56 linking the control lever assembly 50 to the adjuster mechanism, and a counterbalancing mechanism 120 which imposes a force on the control lever assembly 50 that opposes and partially offsets the force imposed on the control lever assembly 50 by the tension element 56.

The adjuster mechanism is a conventional structure adapted to transform movement of the tension element 56 into pivoting movement of the trowel blades 36. The adjuster mechanism includes a yoke (not shown) pivotally secured to the machine frame 22 and a thrust collar (also not shown) overlying the hub. Each trowel blade arm 34 is mounted on an outwardly projecting arm 52 extending outwardly from the hub. Each arm 52 is coupled to the thrust collar by a crank arm 54 that drives the arm 52 to about its axis upon movement of the thrust collar. The tension element, preferably comprising a cable 56, is connected to one end of the yoke such that any movement of the tension element effects a corresponding pivoting of the yoke and hence corresponding movement of the thrust collar, crank arms 54, arms 52, and trowel blade arms 34 in a manner which is, per se, well known.

Referring now to FIGS. 2–8, the control lever assembly 50 is pivotally supported on the machine handle 28 so as to effect cable motion with resultant trowel blade pitch adjustment. Preferably, the control lever assembly 50 is mounted in a housing 58 that in turn is mounted on the upper end 40 of the machine handle 28. The housing 58 includes a floor 60, a pair of opposed side walls 62 and 64, a relatively tall front wall 66, a relatively short rear wall 68, and a cover 70.

Figure 6:
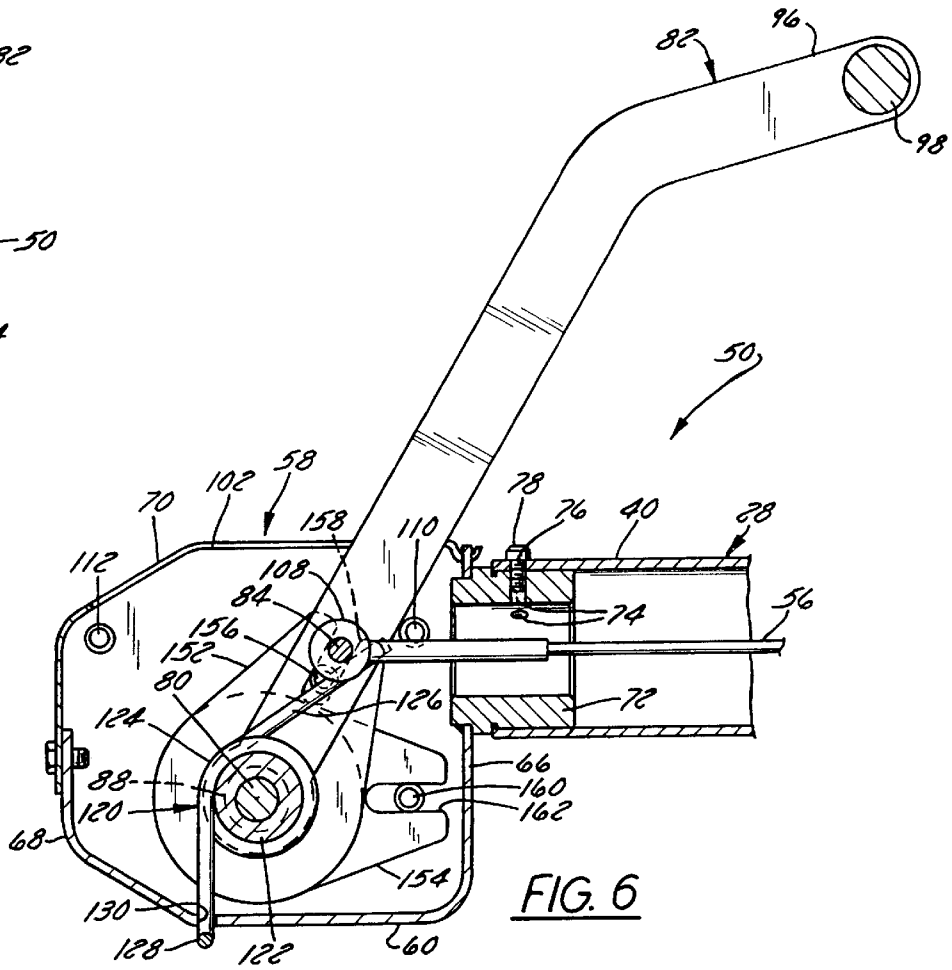
FIG. 6 is a side sectional elevation view of the assembly of FIGS. 3–5, illustrating the control lever assembly in a first, forward position.
Figure 5:
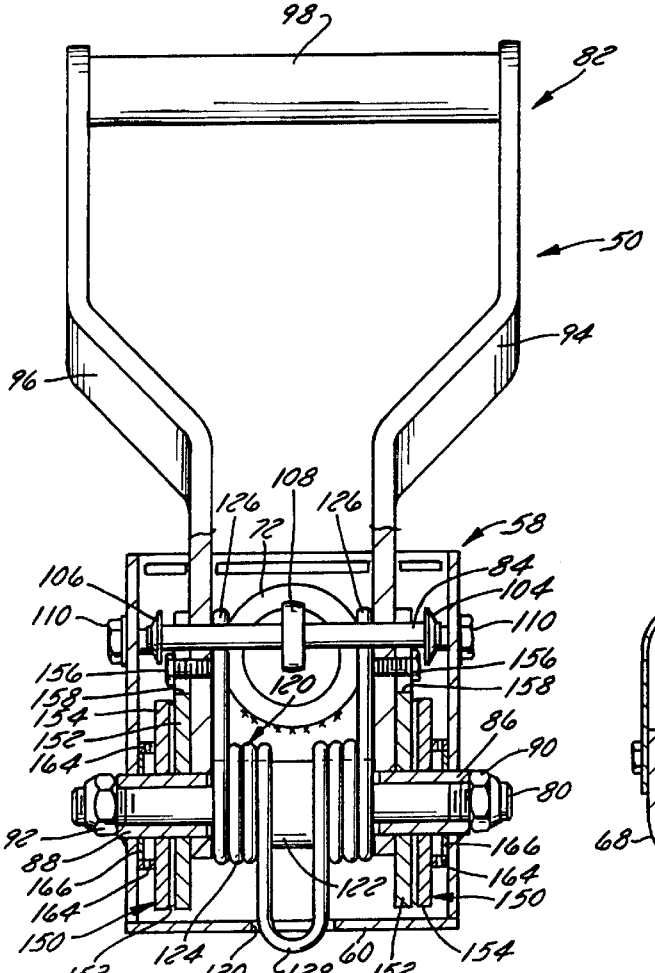
FIG. 5 is a sectional rear elevation view of the assembly of FIGS. 3 and 4.

A collar 72 is received in an aperture formed in the front wall 66 of the housing 58 and is slidably mounted in the tubular end 40 of the machine handle 28 as best seen in FIG. 6. The position of the collar 72 relative to the machine handle 28 can be adjusted to adjust the orientation of the housing 58 and the control lever assembly 50 relative to a vertical plane bisecting the machine handle 28. Preferably, this adjustment is made possible by tapping a plurality of circumferentially spaced threaded bores 74 in the collar 72. The collar 72 and hence the housing 58 are positioned as desired by aligning a selected one of these bores 74 with a hole 76 in the machine handle 28 and by inserting a set screw or bolt 78 through the hole 76 in the machine handle 28 and into threaded engagement with the desired tapped bore 74 in the collar 72. In the illustrated embodiment in which three bores 74 are tapped into the collar 72 at a spacing of approximately 30° from one another, the housing 58 can be mounted either in the vertical plane bisecting the tubular handle 28 or to 30° of either side of that plane.

The control lever assembly 50 is designed to effect rapid motion of the cable 56 and resultant trowel blade pitch adjustment with a reasonable effort. The control lever assembly 50 includes as its major components a support rod 80 extending horizontally across the housing 58, an operator's handle 82 pivotably supported on the rod 80, and a cross member 84 located above the rod 80. The support rod 80 extends through bushings 86 and 88 mounted in apertures formed in the opposed side walls 62 and 64 of the housing 58 and is held in place by nuts 90 and 92 threaded onto the rod 80 at a location outside of the housing 58. The operator's handle 82 includes first and second horizontally-spaced legs 94 and 96 that extend upwardly through elongated slots 100 and 102 in the housing cover 70 and that are connected to one another at their upper ends by a grip 98. The lower end of each of the legs 94 and 96 is pivotally mounted on the support rod 80 between a respective one of the bushings 86 and 88 and a spring mandrel 122 detailed below. Each of the legs 94 and 96 is angled forwardly at its upper end to position the grip 98 at a location which can be comfortably accessed by the operator. The cross member 84 extends between the legs 94 and 96 at a location above the support rod 80. The cross member 84 receives a cable connector 108 that in turn receives the end of the cable 56. Cross member 84 prefereably comprises a dowel pin that is held in place by a pair of press-on washer nuts 104 and 106.

Figure 7:
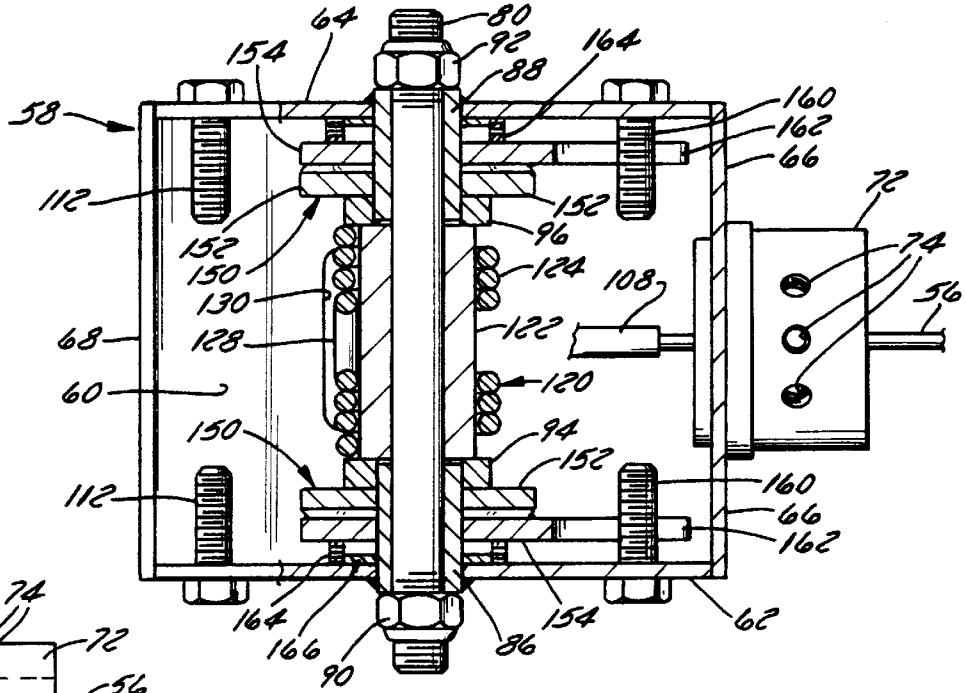
FIG. 7 is a sectional top plan view of the assembly of FIGS. 3–6.
Figure 8:
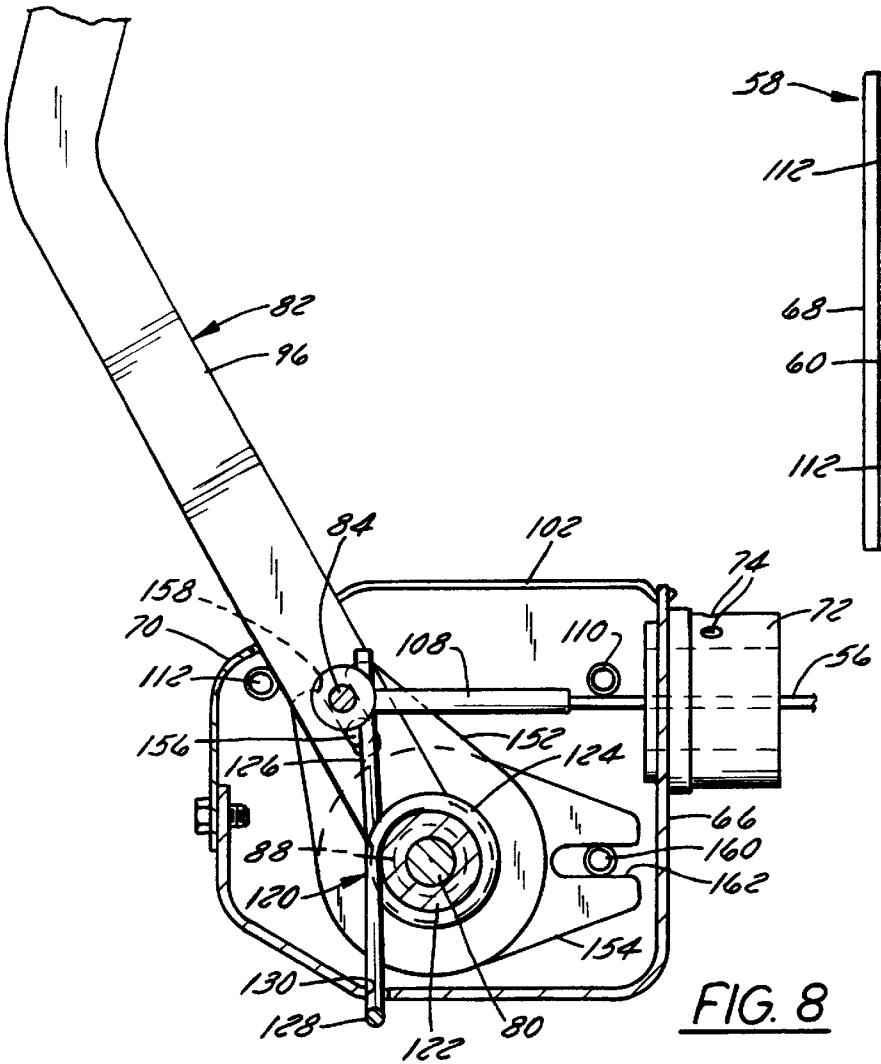
FIG. 8 is a sectional side elevation view corresponding to FIG. 6 and illustrating the control lever assembly in a second, rear position.

As can be seen by comparing FIG. 6 to FIG. 8, pivoting of the operator's handle 82 about the support rod 80 causes the cable 56 to move and hence changes the pitch or inclination of the trowel blades 36. The forward and rearward movement of this pivoting action, and hence the amount of cable movement, is limited by front and rear stops 110 and 112, respectively. These stops take the form of screws threaded into the housing side walls 62 and 64 from the outside.

While the counterbalancing mechanism 120 is not essential to the operation of the trowel blade pitch adjust assembly 30, incorporating the counterbalancing mechanism 120 into the assembly 30 greatly facilitates the assembly's operation because it reduces the net resistance imparted to motion of the control lever assembly 50 when the operator's handle 82 moves rearwardly from its forwardmost position seen in FIG. 6 toward its rearmost position seen in FIG. 8. The counterbalancing mechanism 120 preferably acts directly on the control lever assembly 50 to maximize efficiency and to facilitate assembly. Even more preferably, it is located entirely or nearly entirely within the housing 58 to facilitate a retrofit operation.

Towards these ends, the counterbalancing mechanism 120 preferably takes the form of a torsion spring. The torsion spring 120 is mounted on a spring mandrel 122 that in turn is mounted on the support rod 80 between the legs 94 and 96 of the operator's handle 82. The torsion spring 120 includes a coil 124 that surrounds the mandrel 122, a first end 126 that rests on the cross member 84. and a second end 128 that extends through a slot 130 formed in the floor 60 of the housing 58 and that rests upon the peripheral wall of the slot 130. The spring 120 is sized and located to impart a preload on the cross member 84 the magnitude of which is discussed in Section 4 below.

At least one latch mechanism 150 is preferably provided to hold the control lever assembly 50 in place between pitch adjustment operations and hence to hold the trowel blades 36 in position between adjustment operations. Two such latch mechanisms 150 are provided in the illustrated embodiment. Each latch mechanism 150 is designed not to require any secondary release operation by the operator but rather to release automatically upon the imposition of pivoting actuation forces on the control lever assembly 50 by the operator.

Towards these ends, each of the two illustrated latch mechanisms 150 takes the form of a serrated plate assembly including first and second plates 152 and 154 having selectively intermeshing serrations or teeth 153 that, when intermeshing or engaging with one another, prevent rotation of the plates 152 and 154 relative to one another. Both plates 152 and 154 are nonfixedly mounted on the bushing 86 or 88. The first or inner plate 152 is coupled to the associated operator's handle leg 94 or 96 so that it rotates with the leg. Specifically, a screw 156 extends through a slot 158 in the plate 152 and is threaded into a bore tapped in the leg 94 or 96 beneath the cross member 84 to prevent relative movement between the leg 94 or 96 and the plate 152. The second or outer plate 154 is fixed from rotation with respect to the housing 58 and first plate 152 by another screw 160 that is threaded through the associated side wall 62 or 64 of the housing 58 and that extends into a slot 162 formed in the end of the second plate 154. The second plate 154 is biased into meshing engagement with the first plate 152 by a wave spring stack 164 sandwiched between the outer surface of the second plate 154 and the inner surface of the housing side wall 62 or 64. The wave spring stack 164 is held in a radially centered position with respect to the plate 154 by an annular flat washer 166 disposed radially between the bushing 86 or 88 and the wave spring stack 164.

Figure 11:
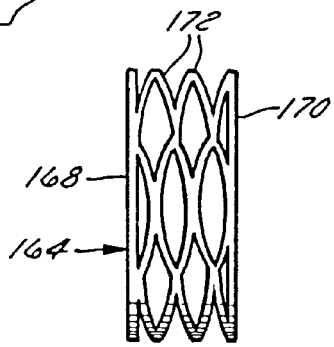
FIG. 11 is a side elevation view of a wave spring stack of the latch mechanism of FIGS. 9 and 10.
Figure 12:
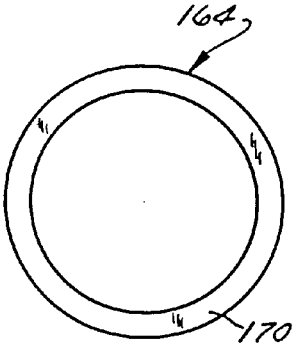
FIG. 12 is an end elevation view of the wave spring stack of FIG. 11.
Figure 10:
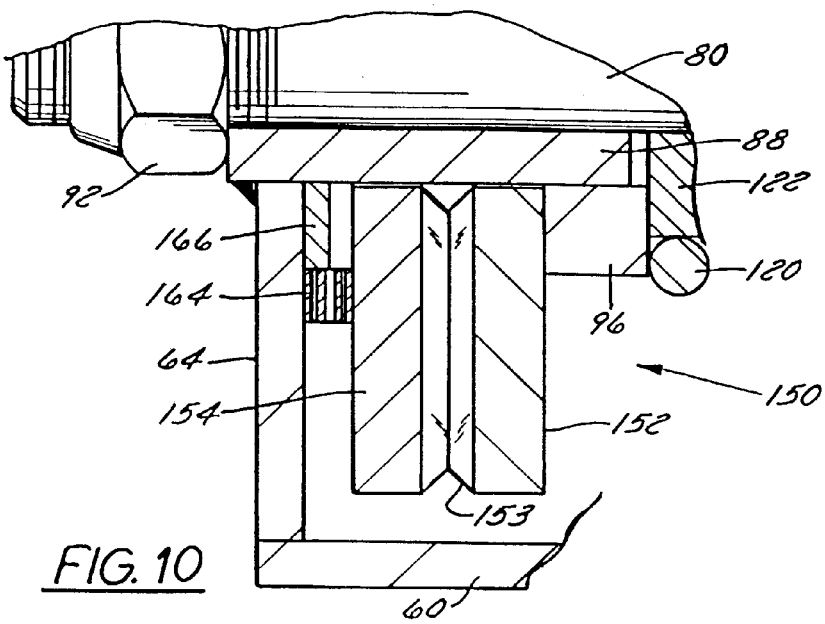
FIG. 10 corresponds to FIG. 9 and illustrates the latch mechanism in a disengaged or unlatched position.

As best seen in FIGS. 11 and 12, wave spring stack 164 takes the form of a mesh or honeycomb-type element having inner and outer ends 168 and 170 separated from one another by a plurality of interconnected loops 172. These loops 172 compress and expand upon the imposition of forces on the ends 168 and 170 in much the same manner as a coil spring.

4. Operation of Trowel Blade Pitch Adjust Assembly

Figure 9:
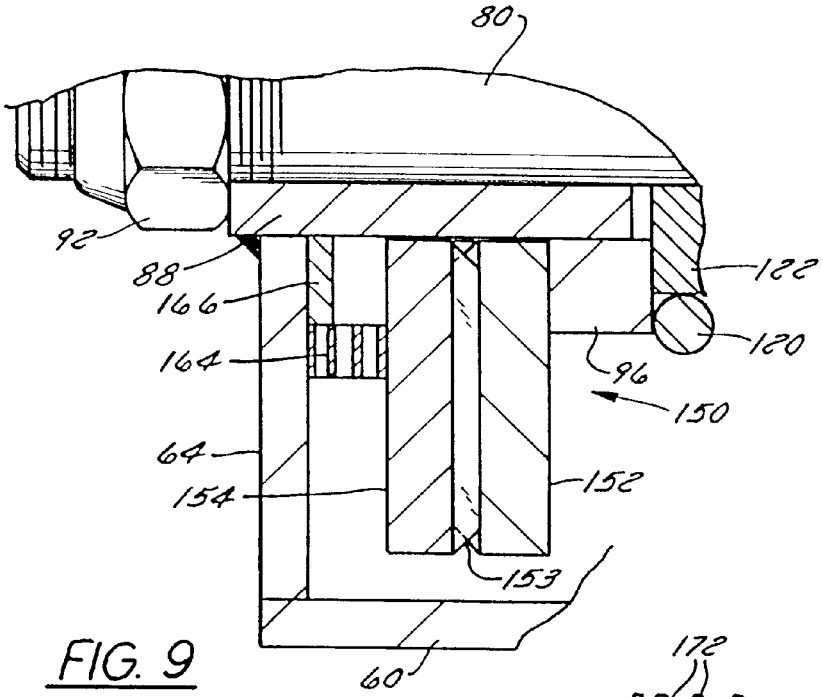
FIG. 9 is an enlarged fragmentary sectional top elevation view illustrating a latch mechanism of the assembly of FIGS. 3–8 in an engaged or latching position.

The operation of the trowel blade pitch adjust assembly 30 will now be described. The trowel blades 36 initially will be set at a predesignated pitch or inclination with the control lever assembly typically being positioned somewhere between its forwardmost position seen in FIG. 6 and its rearmost position seen in FIG. 8 and retained in this position by the latch mechanisms 150. Each latch mechanism 150 assumes the configuration seen in FIG. 9 in which the wave spring stack 164 forces the serrations or teeth 153 of the first and second plates 152 and 154 into intermeshing engagement. When the operator wishes to increase black pitch, e.g., to reconfigure the power trowel 20 for finishing a somewhat drier surface with lower plasticity, he or she simply grasps the grip 98 of the operator's handle 82 and applies a rearward force that tends to pivot the operator's handle 82 counterclockwise as seen in FIGS. 6 and 8. Each latch mechanism 150 will release when the magnitude of this force exceeds a release force defined as the combination of (1) the latching forces imposed by the intermeshing of the latch plate serrations or teeth 153 under the biasing effect of the wave spring stack 164, and (2) the difference between the force imposed on the cross member 84 by the tension cable 56 and the counterbalancing force imposed on the cross member 84 by the torsion spring 120. Continued application of this or a greater force causes the control lever assembly 50 to pivot rearwardly from the position seen in FIG. 6 towards the position seen in FIG. 8 with a resulting blade pitch adjustment.

Blade pitch adjustment occurs rapidly and without excessive operator effort due to the counterbalancing effect of the torsion spring 120. However, some effort is still required because the counterbalancing force imposed on the control lever assembly by the preloaded spring 120 is less than 60% and preferably between 25% and 50% of the maximum force imposed on the control lever assembly by the cable 56 when the entire weight of the power trowel 20 rests on the trowel blades 36. This residual resistive force imparts an indication to the operator that adjustment is occurring and hinders unintended operator's handle overtravel. The relatively small counterbalancing force also inhibits undesirable snapback which would otherwise occur when the operator's handle 82 is operated in the absence of significant tension on the cable 56 that might occur, e.g., when the trowel blades 36 are not resting on the ground.

Once the operator positions the operator's handle 82 in the location required to achieve the desired trowel blade pitch or inclination, he or she simply releases the grip 98. The resultant release of the actuation forces permits the latch mechanisms 150 to reengage under the force of the wave spring stacks 164. As a result, the control lever assembly 50 and hence the trowel blades 36 are maintained in their desired position until the next adjustment operation.

Many changes and modifications may be made to the invention without departing from the spirit thereof. The scope of some of these changes is discussed above. The scope of the remaining changes will become apparent from the appended claims.

I claim:

1. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades relative to said frame, (2) a pivotable control lever assembly which is supported on said machine handle, (3) a tension element which is operatively coupled to said adjuster mechanism and to said control lever assembly and which actuates said adjuster mechanism to alter the pitch of said trowel blades upon pivotal motion of said control lever, wherein said tension element imposes a force on said control lever assembly, wherein said trowel blades are maintained at the adjusted pitch after the adjustment, and (4) a counterbalancing spring which imposes a force on said control lever assembly which opposes and at least partially offsets the force imposed on said control lever assembly by said tension element, wherein said counterbalancing spring assists in the adjustment of the pitch of said trowel blades by offsetting a significant percentage of resistance applied to control lever assembly pivoting imposed by said tension element, and wherein said counterbalancing spring directly engages said control lever assembly.

2. A power trowel as defined in claim 1, further comprising a latch mechanism that applies a force to said control lever assembly which resists pivotal motion of at least a portion of said control lever assembly, said latch mechanism releasing automatically upon the imposition of pivotal forces on said control lever assembly that exceed a designated magnitude.

3. A power trowel as defined in claim 1, further comprising a housing on which said control lever assembly and said counterbalancing mechanism are mounted, wherein said housing is adjustably mounted on said machine handle so that its orientation with respect to a vertical plane bisecting said machine handle can be selectively adjusted.

4. A power trowel as defined in claim 3, wherein said machine handle is tubular and said housing includes an annular collar which mates with said machine handle, and wherein said collar rotates about said machine handle during positional adjustment of said housing.

5. A power trowel as defined in claim 1, wherein said power trowel is a concrete finishing machine.

6. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage Of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades relative to said frame, (2) a pivotable control lever assembly which is supported on said machine handle, (3) a tension element which is operatively coupled to said adjuster mechanism and to said control lever assembly and which actuates said adjuster mechanism to alter the pitch of said trowel blades upon pivotal motion of said control lever, wherein said tension element imposes a force on said control lever assembly, and (4) a counterbalancing mechanism which imposes a force on said control lever assembly which opposes and at least partially offsets the force imposed on said control lever assembly by said tension element, wherein both said tension element and said counterbalancing mechanism is connected directly to said control lever assembly, and wherein said counterbalancing mechanism comprises a torsion spring having a first end which engages said control lever assembly and a second end which engages a stationary member.

7. A power trowel as defined in claim 6, wherein said tension element comprises a cable having a first end attached to said adjuster mechanism and a second end directly attached to said control lever assembly.

8. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades relative to said frame, (2) a pivotable control lever assembly which is supported on said machine handle, (3) a tension element which is operatively coupled to said adjuster mechanism and to said control lever assembly and which actuates said adjuster mechanism to alter the pitch of said trowel blades upon pivotal motion of said control lever assembly, wherein said tension element imposes a force on said control lever assembly, and (4) a counterbalancing spring which imposes a force on said control lever assembly which opposes and partially offsets the force imposed on said control lever assembly by said tension element, wherein both said tension element and said counterbalancing spring directly engage said control lever assembly, wherein the force imposed on said control lever assembly by said counterbalancing spring is no more than 60% of the maximum force imposed on said control lever assembly by said tension element.

9. A power trowel as defined in claim 8, wherein the force imposed on said control lever assembly by said counterbalancing mechanism is about 25% to 50% of the maximum force imposed on said control lever assembly by said tension element.

10. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades relative to said frame, (2) a pivotable control lever assembly which is supported on said machine handle, (3) a tension element which is operatively coupled to said adjuster mechanism and to said control lever assembly and which actuates said adjuster mechanism to alter the pitch of said trowel blades upon pivotal motion of said control lever, wherein said tension element imposes a force on said control lever assembly, and (4) a counterbalancing mechanism which imposes a force on said control lever assembly which opposes and at least partially offsets the force imposed on said control lever assembly by said tension element, wherein both said tension element and said counterbalancing mechanism are connected directly to said control lever assembly; and (E) a latch mechanism that applies a force to said control lever assembly which resists pivotal motion of at least a portion of said control lever assembly, said latch mechanism releasing automatically upon the imposition of pivotal forces on said control lever assembly that exceed a designated magnitudes wherein said latch mechanism comprises 1) a first serrated plate which is rotatably mounted on a support rod, 2) a second serrated plate which is movable axially with respect to said support rod to selectively a) intermesh with said first serrated plate to prevent rotation of said first serrated plate relative to said second serrated plate and b) move away from said first serrated plate to permit said first serrated plate to rotate relative to said second serrated plate and, and 3) a biasing mechanism which biases said second serrated plate into meshing engagement with said first serrated plate.

11. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades relative to said frame, (2) a housing which is mounted on an upper end of said machine handle, (3) a control lever assembly which is pivotably mounted in said housing, said control lever assembly including (a) a rod extending horizontally across said housing, (b) an operator's handle pivotally supported on said rod and including first and second horizontally-spaced legs, and (c) a cross member bridging said legs at a location above said rod, (4) a cable which has a first end attached to said adjuster mechanism and a second end attached to said cross member, wherein said cable actuates said adjuster mechanism to alter the pitch of said trowel blades upon pivotal motion of said control lever assembly, wherein said cable imposes a force on said control lever assembly, and (5) a counterbalancing mechanism which imposes a return force on said control lever assembly which opposes and at least partially offsets the force imposed on said control lever assembly by said cable, wherein the force imposed on said control lever assembly by said counterbalancing mechanism is between 25% and 50% of the maximum force imposed on said control lever assembly by said cable, said counterbalancing mechanism comprises a torsion spring mounted on said rod between said first and second legs of said operator's handle, and wherein said torsion spring has a first end which abuts said cross member and a second end which abuts said housing.

12. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades, (2) a pivotable control lever assembly which is supported on said machine handle, and (3) a tension element which is operatively coupled to said adjuster mechanism and to said control lever assembly and which actuates said adjuster mechanism to alter the pitch of said trowel blades upon pivotal motion of said control lever; and (E) a latch mechanism which applies a force to said control lever assembly which resists pivotal motion of at least a portion of said control lever assembly, said latch mechanism releasing automatically upon the imposition of pivotal forces on said control lever assembly that exceed a designated magnitude.

13. A power trowel comprising:

(A) a frame, (B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame;

(D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades, (2) a pivotable control lever assembly which is supported on said machine handle, and (3) a tension element which is operatively coupled to said adjuster mechanism and to said control lever assembly and which actuates said adjuster mechanism to alter the pitch of said trowel blades upon pivotal motion of said control lever;

(E) a latch mechanism which applies a force to said control lever assembly which resists pivotal motion of at least a portion of said control lever assembly, said latch mechanism releasing automatically upon the imposition of pivotal forces on said control lever assembly that exceed a designated magnitude; and (F) a support rod on which said latch mechanism is mounted, and wherein said latch mechanism comprises 1) a first serrated plate which is rotatably mounted on said support rod, 2) a second serrated plate which is movable axially with respect to said support rod to selectively a) intermesh with said first serrated plate to prevent rotation of said first serrated plate relative to said second serrated plate and b) move away from said first serrated plate to permit said first serrated plate to rotate relative to said second serrated plate and, and 3) a biasing mechanism which biases said second serrated plate into meshing engagement with said first serrated plate.

14. A power trowel as defined in claim 13, wherein said biasing mechanism comprises a wave spring stack.

15. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including, (1) an adjuster mechanism which is operatively coupled to said trowel blades and which is selectively actuatable to adjust the pitch of said trowel blades, (2) a pivotable control lever assembly which is supported on said machine handle, and (3) a tension element which is operatively coupled to said adjuster mechanism and to said control lever assembly and which actuates said adjuster mechanism to alter the pitch of said trowel blades upon pivotal motion of said control lever;

(E) a latch mechanism which applies a force to said control lever assembly which resists pivotal motion of at least a portion of said control lever assembly, said latch mechanism releasing automatically upon the imposition of pivotal forces on said control lever assembly that exceed a designated magnitude, wherein said latch mechanism comprises a first latch mechanism, and (F) a second latch mechanism mounted on said support rod in a spaced-apart relationship with respect to said first latch mechanism, said second latch mechanism comprising 1) a third serrated plate which is rotatably mounted on said support rod, 3) a fourth serrated plate which selectively intermeshes with said third serrated plate and which is movable axially with respect to said support rod, and 4) a second biasing mechanism which biases said fourth serrated plate into meshing engagement with said third serrated plate.

16. A method comprising:

(A) providing a power trowel comprising (5) a frame, (6) a plurality of trowel blades each of which has a bottom surface which rests on a surface to be troweled, wherein each of said trowel blades is rotatable with respect to said frame and has a variable pitch with respect to said frame so that the percentage of the bottom surface of each trowel blade that contacts the surface to be troweled is variable, (7) a machine handle which extends upwardly from said frame, and (8) a pivotable control lever assembly which is supported on said machine handle and which is operatively coupled to an adjuster mechanism for said trowel blades, (B) applying a latching force to said control lever assembly which resists pivotal motion of at least a portion of said control lever assembly, said latching force being applied by a latch mechanism;

(C) automatically releasing said latch mechanism by applying a pivoting force to said control lever assembly of sufficient magnitude to overcome said latching force then (D) pivoting said control lever assembly to adjust the pitch of said trowel blades; and then (E) automatically reengaging said latch mechanism upon release of said pivoting force.

17. A method as defined in claim 16, further comprising automatically reengaging said latch mechanism upon release of said pivoting force.

18. A method as defined in claim 16, the surface to be troweled comprises a concrete surface.

19. A method comprising:

(A) providing a power trowel comprising:

(1) a frame, (2) a plurality of trowel blades each of which has a bottom surface which rests on a surface to be troweled, wherein each of said trowel blades is rotatable with respect to said frame and has a variable pitch with respect to said frame so that the percentage of the bottom surface of each trowel blade that contacts the surface to be troweled is variable, (3) a machine handle which extends upwardly from said frame, and (4) a pivotable control lever assembly which is supported on said machine handle and which is operatively coupled to an adjuster mechanism for said trowel blades, (B) applying a latching force to said control lever assembly which resists pivotal motion of said control lever assembly, said latching force being applied by a latch mechanism;

(C) releasing said latch mechanism by applying a pivoting force to said control lever assembly of sufficient magnitude to overcome said latching force; and then (D) pivoting said control lever assembly to adjust the pitch of said trowel blades, wherein said step of applying said latching force comprises biasing first and second serrated plates into meshing engagement with one another, said first serrated plate rotating upon pivotal movement of said lever assembly and second serrated plate being movable axially with respect to said first serrated plate.

20. A method comprising:

(A) providing a power trowel comprising (1) a frame, (2) a plurality of trowel blades each of which has a bottom surface which rests on a surface to be troweled, wherein each of said trowel blades is rotatable with respect to said frame and has a variable pitch with respect to said frame so that the percentage of the bottom surface of each trowel blade that contacts the surface to be troweled is variable, (3) a machine handle which extends upwardly from said frame, and (4) a pivotable control lever assembly which is supported on said machine handle and which is operatively coupled to an adjuster mechanism for said trowel blades by a tension element, (B) pivoting said control lever assembly to adjust the pitch of said trowel blades; and (C) assisting lever pivoting by applying a counterbalancing force to said control lever assembly that offsets a resistive force imposed to said control lever assembly by said tension element and that is no more than 60% of the maximum force imposed on said control lever assembly by said tension element.

21. A method as defined in claim 20, wherein said counterbalancing force is about 25% to 50% of the maximum force imposed on said control lever assembly by said tension element.

22. A method as defined in claim 20, wherein said resistive force is imposed directly on said control lever assembly by said tension element, and wherein said counterbalancing force is applied directly on said control lever assembly by a torsion spring.

23. A power trowel comprising:

(A) a frame;

(B) a plurality of trowel blades each of which has a bottom surface which is configured to rest on a surface to be troweled, wherein each of said trowel blades is rotatable with respect to said frame and has a variable pitch with respect to said frame so that the percentage of the bottom surface of each trowel blade that contacts the surface to be troweled is variable;

(C) a machine handle which extends upwardly from said frame; and (D) a trowel blade pitch adjust assembly which selectively adjusts the pitch of said trowel blades, said trowel blade pitch adjust assembly including (1) an adjuster mechanism which is operatively coupled to said trowel blades and which is selectively actuatable to adjust the pitch of said trowel blades, (2) a control lever assembly which is supported on said machine handle and which is pivotable about a pivot axis, and (3) a tension element which is operatively coupled to said adjuster mechanism and to said control lever assembly and which actuates said adjuster mechanism to alter the pitch of said trowel blades upon pivotal motion of said control lever; and (E) a latch mechanism which applies a force to said control lever assembly which resists pivotal motion of at least a portion of said control lever assembly, said latch mechanism releasing automatically upon the imposition of pivotal forces on said control lever assembly that exceed a designated magnitude, wherein, during latch mechanism release, a first portion of said latch mechanism moves at least generally parallel to said pivot axis relative to a second portion of said latch mechanism so as to permit relative pivoting movement between said first and second portions.

24. A power trowel as defined in claim 23, wherein said latch mechanism further comprises a biasing element which biases said first and second portions of said latch mechanism together.

* * * * *